US012329331B2

(12) United States Patent
Ren

(10) Patent No.: US 12,329,331 B2
(45) Date of Patent: Jun. 17, 2025

(54) CONNECTOR AND TOILET INSTALLATION COMPONENT

(71) Applicant: Xiamen Beewill Sanitary Co., Ltd., Xiamen (CN)

(72) Inventor: Shisong Ren, Xiamen (CN)

(73) Assignee: Xiamen Beewill Sanitary Co., Ltd., Xiamen (CN)

( * ) Notice: Subject to any disclaimer, the term of this patent is extended or adjusted under 35 U.S.C. 154(b) by 157 days.

(21) Appl. No.: 18/200,608

(22) Filed: May 23, 2023

(65) Prior Publication Data

US 2023/0404336 A1 Dec. 21, 2023

(30) Foreign Application Priority Data

Jun. 15, 2022 (CN) ..... 202210679091.0

(51) Int. Cl.
*A47K 13/12* (2006.01)

(52) U.S. Cl.
CPC ..... *A47K 13/12* (2013.01)

(58) Field of Classification Search
CPC ..... A47K 13/12
See application file for complete search history.

(56) References Cited

FOREIGN PATENT DOCUMENTS

| | | | | |
|---|---|---|---|---|
| CN | 101766459 A | * | 7/2010 | ..... A47K 13/12 |
| CN | 102258347 A | * | 11/2011 | ..... A47K 13/12 |
| JP | 2020117881 A | * | 8/2020 | |

* cited by examiner

*Primary Examiner* — Christine J Skubinna

(57) ABSTRACT

A connector and a toilet installation component are provided. The connector has an elastic piece, the elastic piece is provided with a hook, and a first end of the elastic piece is provided with a shifting knob. Therefore, the connector can be quickly disassembled without the help of a tool, so that a toilet cover plate is better replaced with different hinges, thereby improving efficiency and meanwhile avoiding damage to the toilet cover plate due to violent removal of the hinges.

8 Claims, 14 Drawing Sheets

CONNECTOR AND TOILET INSTALLATION COMPONENT

CROSS REFERENCE TO THE RELATED APPLICATIONS

This application is based upon and claims priority to Chinese Patent Application No. 202210679091.0, filed on Jun. 15, 2022, the entire contents of which are incorporated herein by reference.

TECHNICAL FIELD

The present disclosure relates to the technical field of toilets, in particular to a connector and a toilet installation component.

BACKGROUND

When installing a toilet cover plate, the toilet cover plate is usually disposed on a toilet body, a rotating shaft is disposed on the toilet cover plate, and the toilet cover plate is connected with the rotating shaft through a connector.

In the related art, the connector is generally disposed to be of a U-shaped structure, with one end inserted into a clamping groove of the rotating shaft and the other end connected with the toilet cover plate. After installation, the connector is not easy to disassemble and requires a tool due to a small gap between two ends of the connector, and at the same time, the connector is prone to be damaged in a disassembly process. In addition, the connector of this structure makes the toilet cover plate matched with it needs to be manufactured through a corresponding mold, resulting in poor universality of the connector and increasing a usage cost.

SUMMARY

The present disclosure aims to at least solve one of the technical problems in the above technology to a certain extent. To this end, one objective of the present disclosure is to provide a connector, which can be quickly disassembled without the help of a tool, and meanwhile can adapt to various toilet cover plates, so as to improve universality and meanwhile reduce cost.

A second objective of the present disclosure is to provide a toilet installation component.

To achieve the above objectives, an embodiment of a first aspect of the present disclosure provides a connector, the connector has an elastic piece, the elastic piece is provided with a hook, and a first end of the elastic piece is provided with a shifting knob.

According to the connector of the embodiment of the present disclosure, the connector has the elastic piece, the elastic piece is provided with the hook, and the first end of the elastic piece is provided with the shifting knob, so that the connector can be quickly disassembled without the help of a tool, and meanwhile can adapt to various toilet cover plates, so as to improve universality and meanwhile reduce cost.

In addition, the connector provided according to the above embodiment of the present disclosure can further have the following additional technical features.

Optionally, the first end of the elastic piece forms a step by bending to obtain the shifting knob.

Optionally, a second end of the elastic piece is provided with a fixing piece.

Optionally, the fixing piece is of a ring sleeve structure.

Optionally, fixing pieces are symmetrically disposed on left and right sides of the elastic piece.

To achieve the above objectives, an embodiment of a second aspect of the present disclosure provides a toilet installation component, including:

a toilet cover, provided with a first through hole; a toilet seat ring, provided with a second through hole; a rotating shaft, penetrating through the second through hole and connected with the first through hole of the toilet cover or penetrating through the first through hole and connected with the second through hole of the toilet seat ring, wherein the rotating shaft is provided with a first clamping groove; and a connector, having an elastic piece, wherein the elastic piece is provided with a hook, a first end of the elastic piece is provided with a shifting knob, the connector is disposed in the first through hole or the second through hole, and the hook is inserted in the first clamping groove of the rotating shaft.

According to the toilet installation component of the embodiment of the present disclosure, the toilet cover is provided with the first through hole; the toilet seat ring is provided with the second through hole; the rotating shaft penetrates through the second through hole and is connected with the first through hole of the toilet cover or the rotating shaft penetrates through the first through hole and is connected with the second through hole of the toilet seat ring, and the rotating shaft is provided with the first clamping groove; and the connector has the elastic piece, the elastic piece is provided with the hook, the first end of the elastic piece is provided with the shifting knob, the connector is disposed in the first through hole or the second through hole, and the hook is inserted in the first clamping groove of the rotating shaft. Therefore, the connector can be quickly disassembled without the help of a tool, and meanwhile can adapt to various toilet cover plates, so as to improve universality and meanwhile reduce cost.

In addition, the toilet installation component provided according to the above embodiment of the present disclosure can further have the following additional technical features.

Optionally, a second end of the elastic piece is provided with a fixing piece, the first through hole or the second through hole is internally provided with a first groove, and the first groove is internally provided with a second clamping groove matched with the fixing piece.

Optionally, the fixing pieces are symmetrically disposed on left and right sides of the elastic piece, the first through hole or the second through hole is internally provided with the first groove, and the first groove is internally provided with the second clamping groove matched with the fixing pieces.

Optionally, the connector is disposed in the first groove, and the fixing piece is disposed in the second clamping groove, so as to fix the connector axially.

Optionally, the shifting knob extends beyond the first through hole or the second through hole.

Optionally, the rotating shaft is connected with the first through hole or the second through hole through the first end, and a second end of the rotating shaft is provided with a second groove.

DESCRIPTION OF REFERENCE NUMERALS

Figure 1:
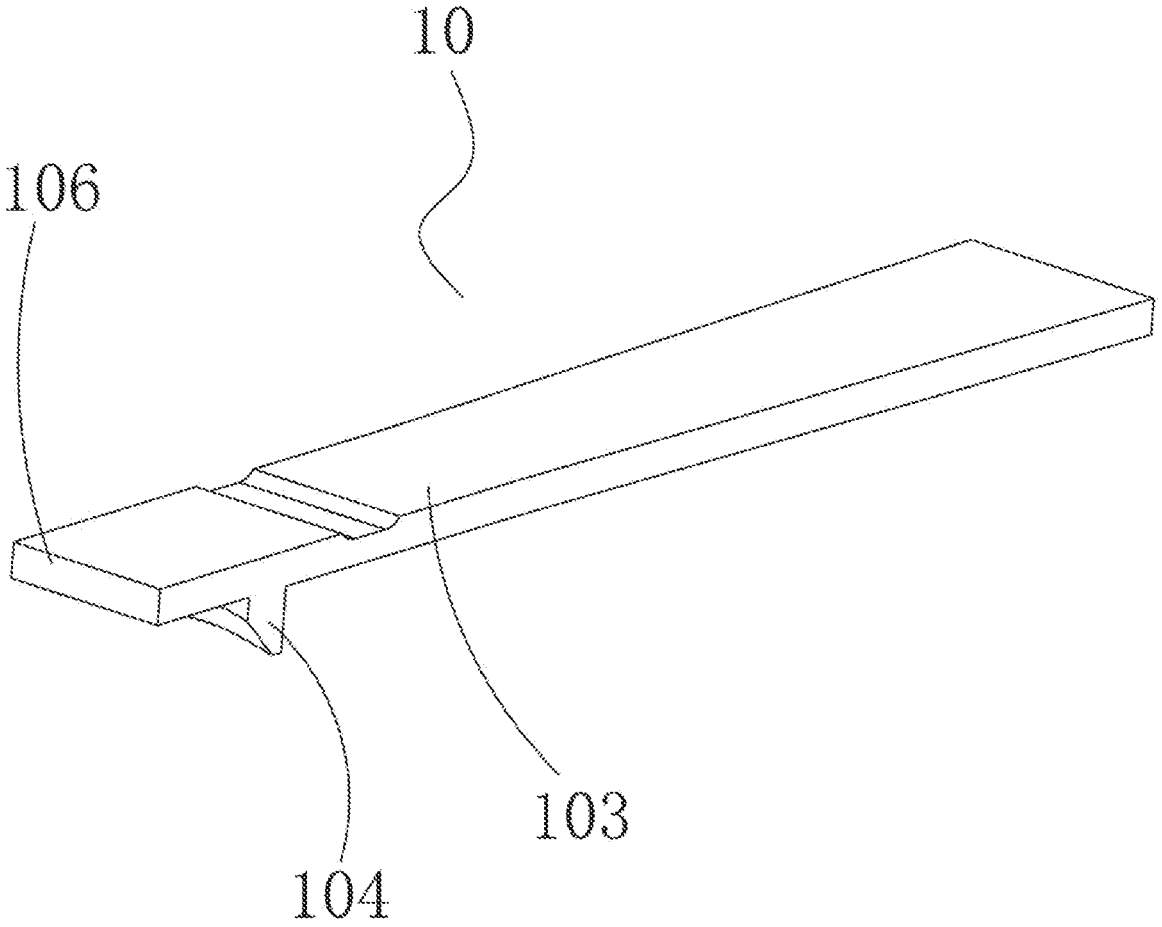
FIG. 1 is a schematic structural diagram of a connector according to an embodiment of the present disclosure.

Connector 10, Fixing piece 101, First opening 102, Elastic piece 103, Hook 104, Section 105, Shifting knob 106, Toilet cover 20, First through hole 201, Toilet seat ring 30, Second through hole 301, First groove 302, Rotating shaft 40, First clamping groove 401, and Second groove 402.

DETAILED DESCRIPTION OF THE EMBODIMENTS

Embodiments of the present disclosure are described below in detail. Examples of the embodiments are shown in accompanying drawings. The same or similar reference numbers represent the same or similar elements or elements with the same or similar functions from beginning to end. The embodiments described below with reference to the accompanying drawings are exemplary, are intended to explain the present disclosure, and cannot be interpreted as limitation on the present disclosure.

In order to better understand the above technical solution, the exemplary embodiments of the present disclosure will be described in more detail below with reference to the accompanying drawings. Although the accompanying drawings show the exemplary embodiments of the present disclosure, it should be understood that the present disclosure can be implemented in various forms and should not be limited by the embodiments illustrated here. On the contrary, these embodiments are provided to enable a more thorough understanding of the present disclosure and to completely convey the scope of the present disclosure to those skilled in the art.

In order to better understand the above technical solution, the above technical solution will be illustrated in detail below with reference to the accompanying drawings of the specification and specific implementations.

As shown in FIG. 1, a connector 10 has an elastic piece 103, the elastic piece 103 is provided with a hook 104, and a first end of the elastic piece 103 is provided with a shifting knob 106.

It should be noted that the connector 10 may be axially and fixedly disposed in a second through hole 301 of a toilet seat ring 30, and clamped on a first clamping groove 401 of a rotating shaft 40 through the hook 104, so that a toilet cover 20 and a toilet seat ring 30 are fixed on a toilet body through the rotating shaft 40. After the shifting knob 106 is shifted radially and the hook 104 is separated from the first clamping groove 401 of the rotating shaft 40, the rotating shaft 40 can be pulled out. Therefore, the connector can be quickly disassembled without the help of a tool, and meanwhile can adapt to various toilet cover plates, so as to improve universality and meanwhile reduce cost.

Figure 2:
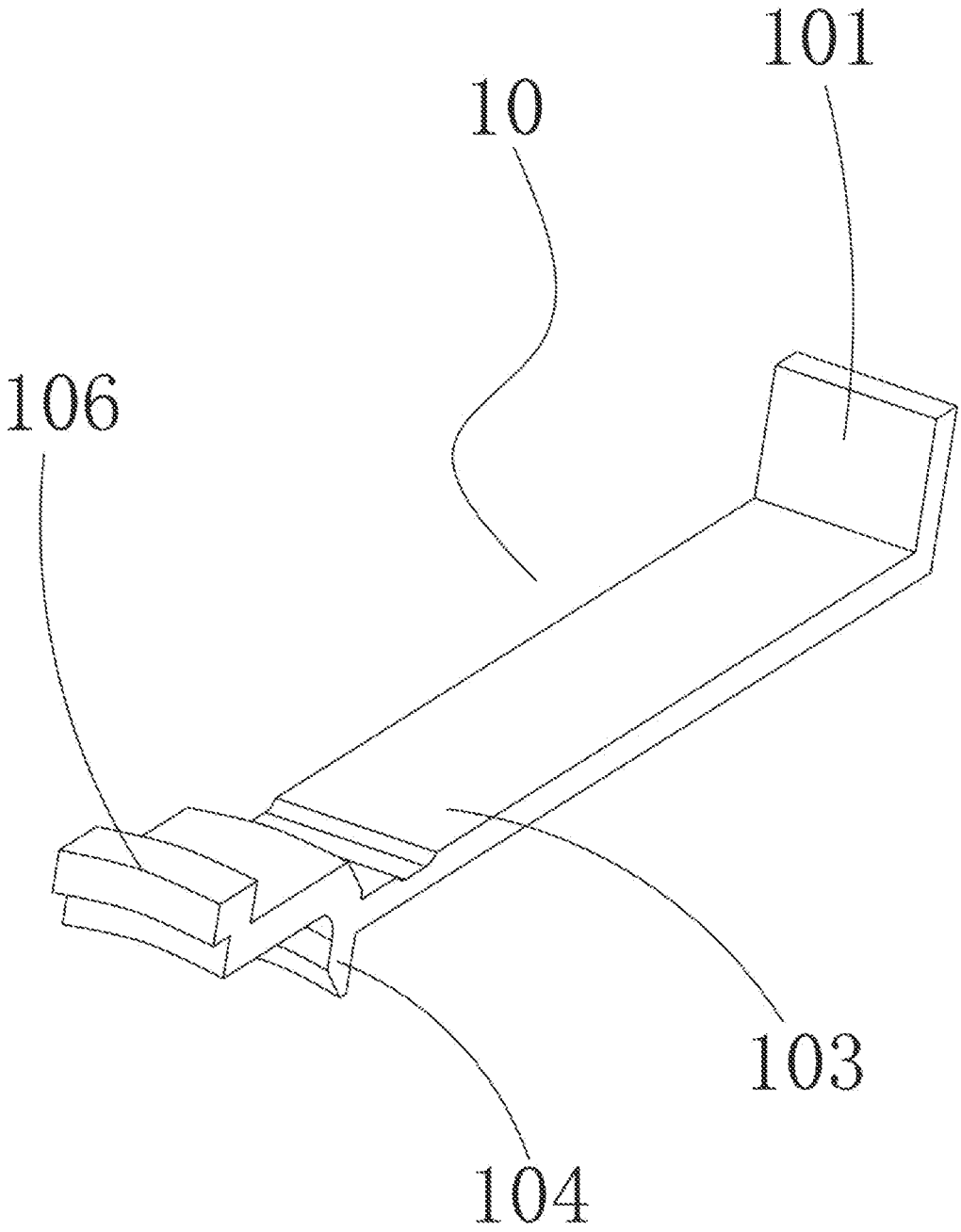
FIG. 2 is a schematic structural diagram of a connector according to one embodiment of the present disclosure.
Figure 3:
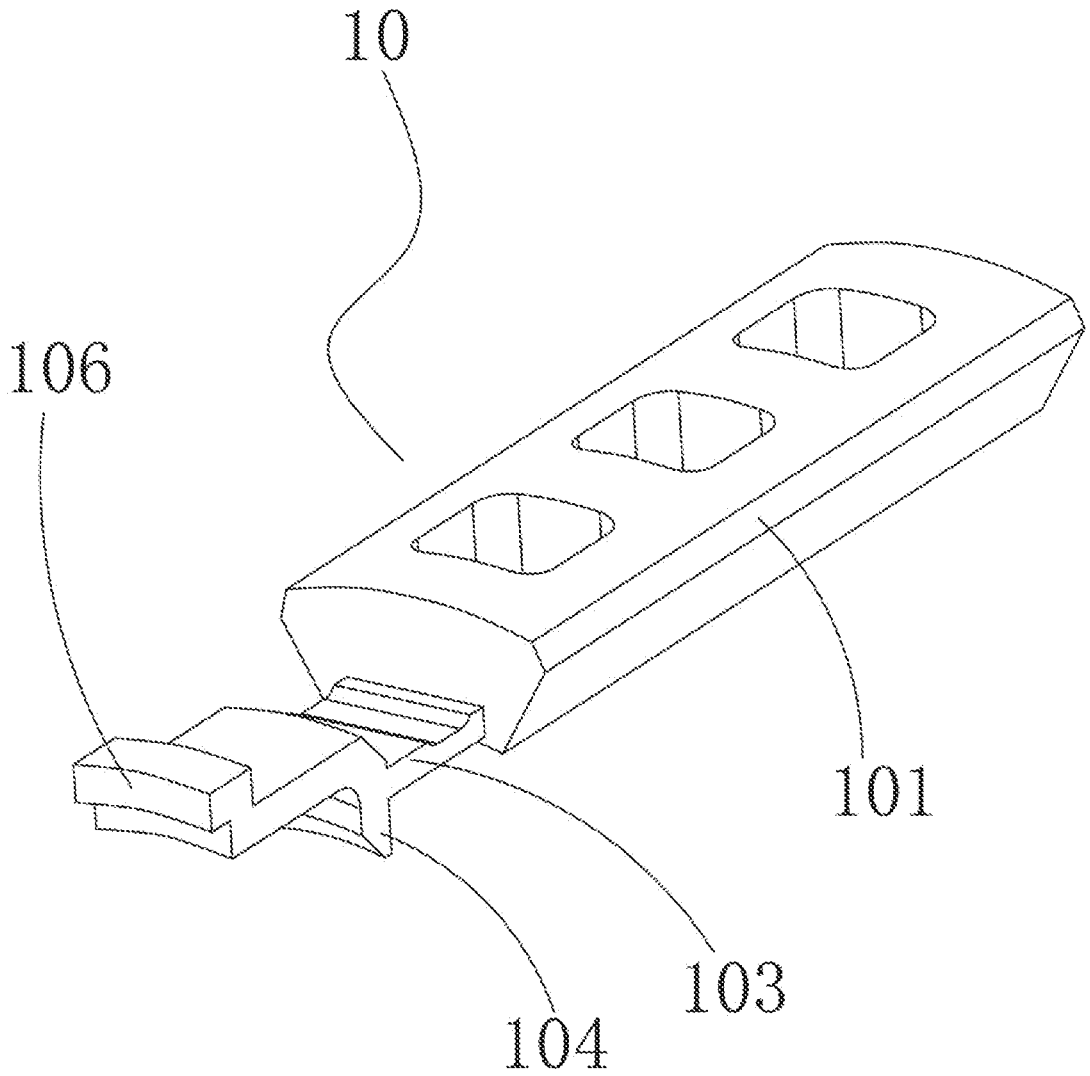
FIG. 3 is a schematic structural diagram of a connector according to one embodiment of the present disclosure.

As an embodiment, as shown in FIG. 2-FIG. 3, the first end of the elastic piece 103 forms a step by bending to obtain the shifting knob 106, so that there is a certain gap between the shifting knob 106 and the rotating shaft 40 after installation of the connector, so that the shifting knob 106 can be shifted by stretching a finger into the rotating shaft 40 to facilitate disassembly. In addition, a second end of the elastic piece 103 is provided with a fixing piece 101 to fix an axial position of the connector 10, so as to increase the strength of the connector 10.

Figure 4:
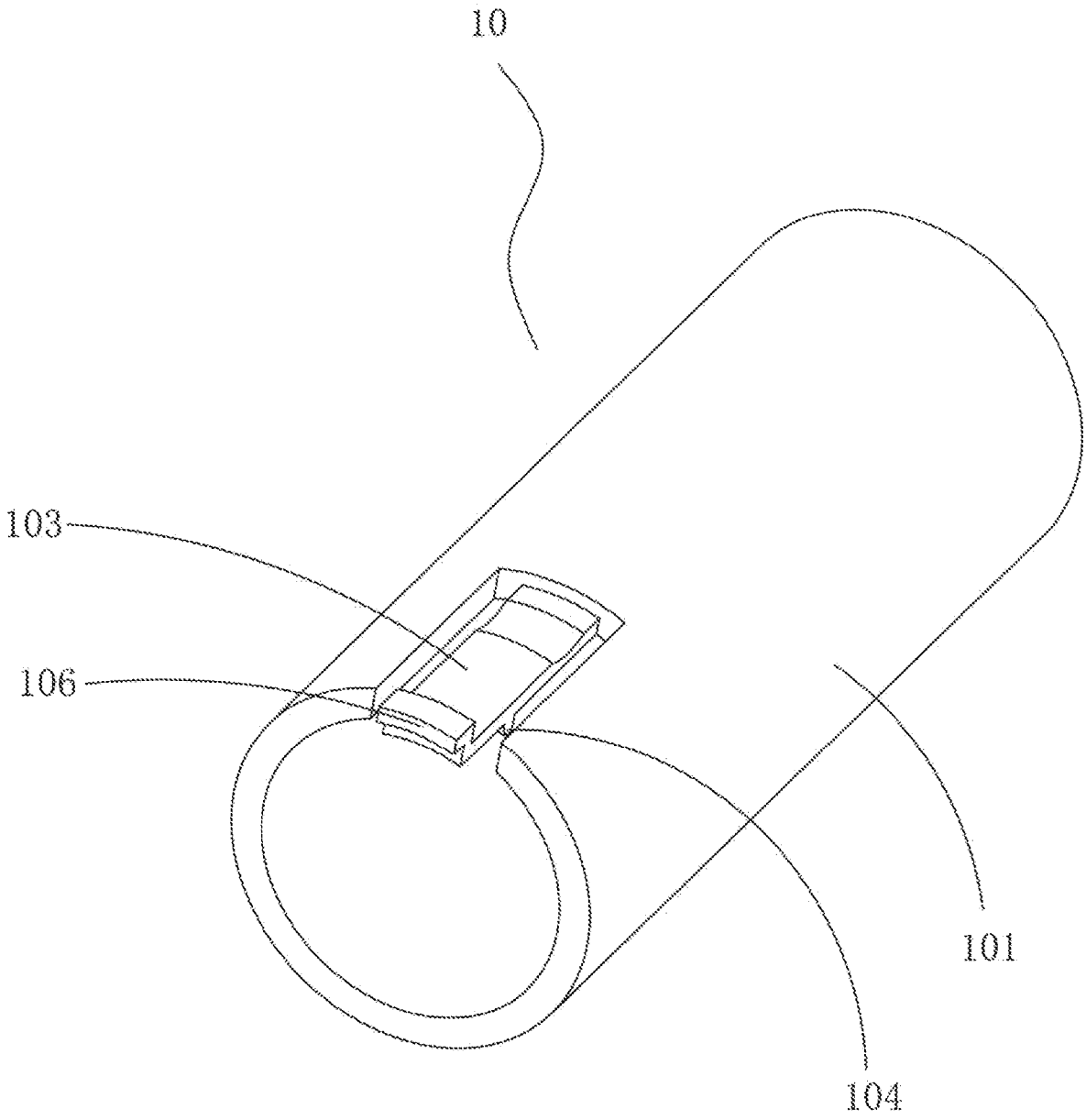
FIG. 4 is a schematic structural diagram of a connector according to one embodiment of the present disclosure.

As an embodiment, as shown in FIG. 4, the fixing piece 101 is of a ring sleeve structure. The ring sleeve is provided with a second opening, and the elastic piece 103 is disposed on the second opening, and is integrally formed with the fixing piece 101 through the second end.

Figure 5:
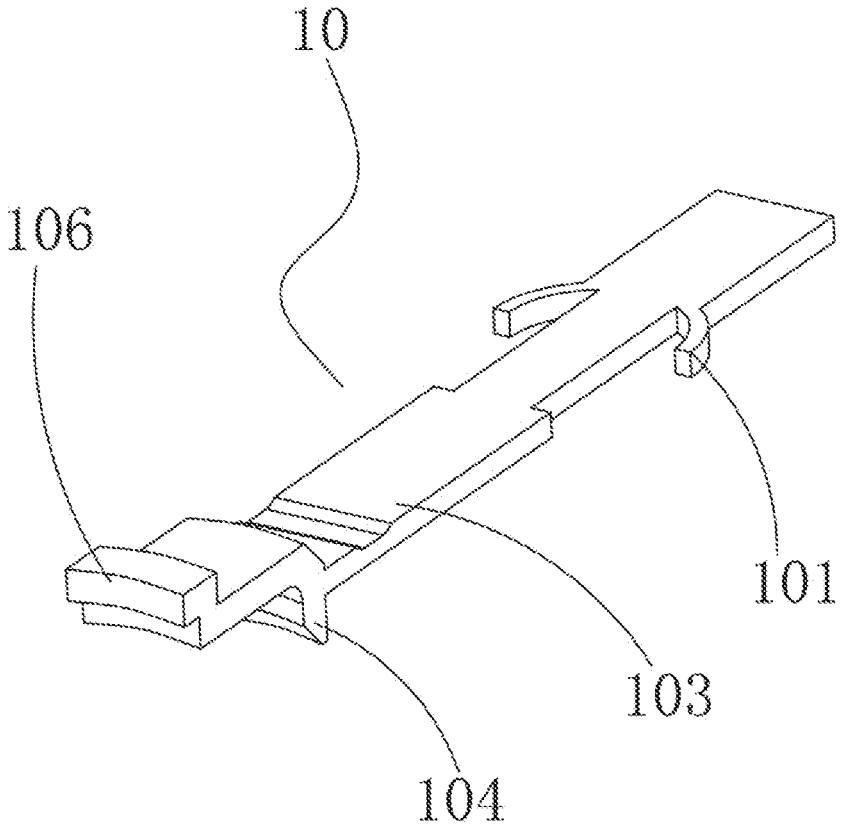
FIG. 5 is a schematic structural diagram of a connector according to one embodiment of the present disclosure.

As an embodiment, as shown in FIG. 5, fixing pieces 101 are symmetrically disposed on left and right sides of the elastic piece 103 to fix the axial position of the connector 10, so as to further increase the strength of the connector 10.

Figure 6:
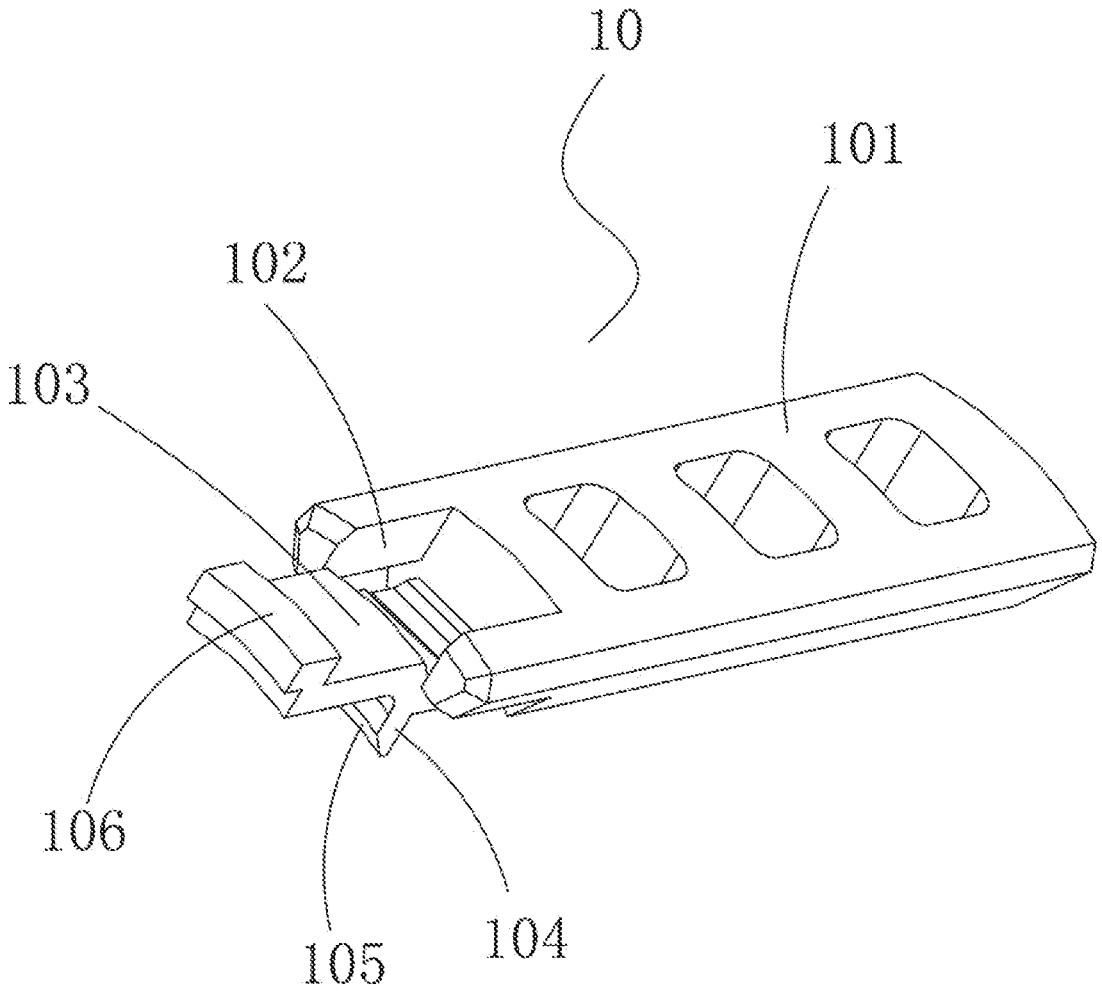
FIG. 6 is a schematic structural diagram of a connector according to one embodiment of the present disclosure.
Figure 7:
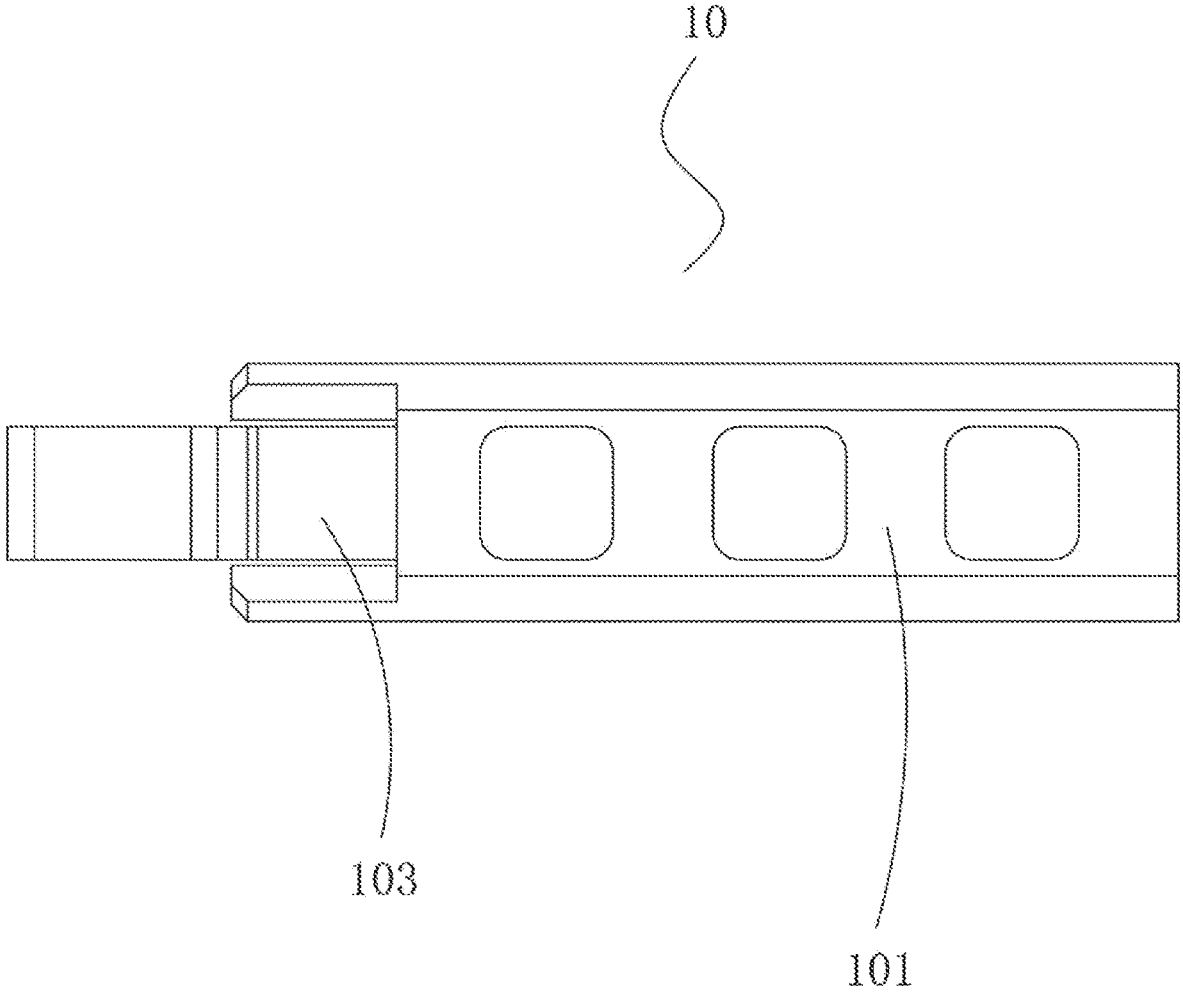
FIG. 7 is a schematic structural top view of a connector according to one embodiment of the present disclosure.
Figure 8:
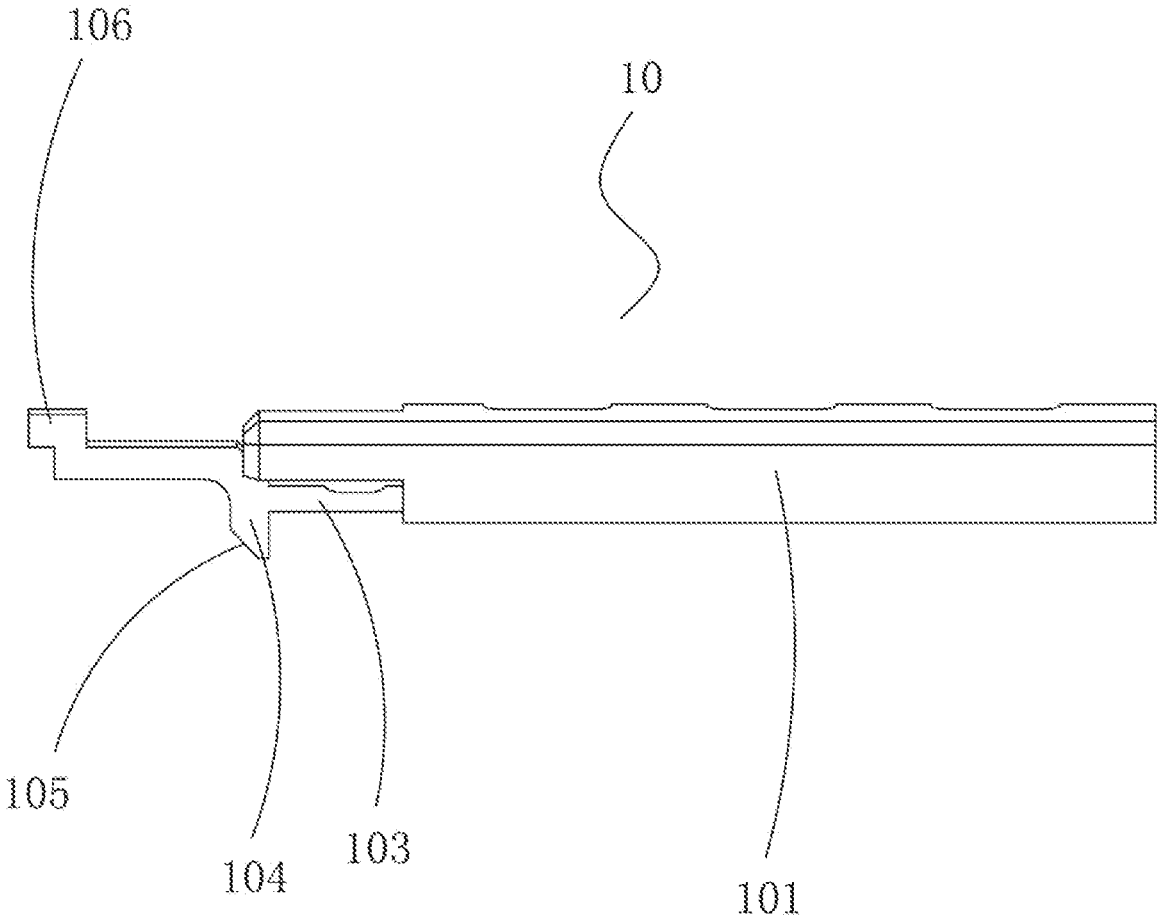
FIG. 8 is a schematic structural left view of a connector according to one embodiment of the present disclosure.
Figure 9:
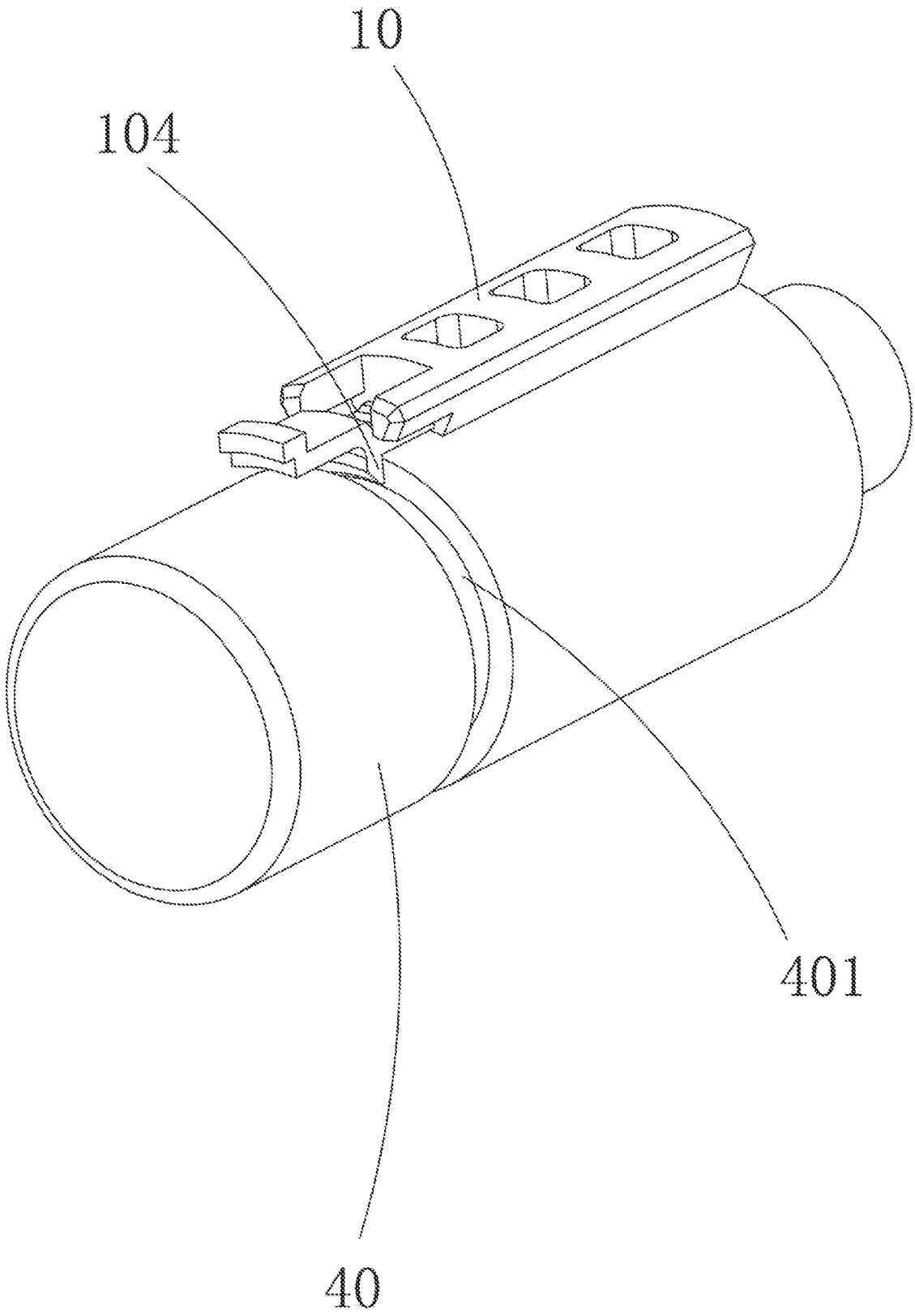
FIG. 9 is a schematic diagram of a connecting structure of a connector and a rotating shaft according to an embodiment of the present disclosure.
Figure 10:
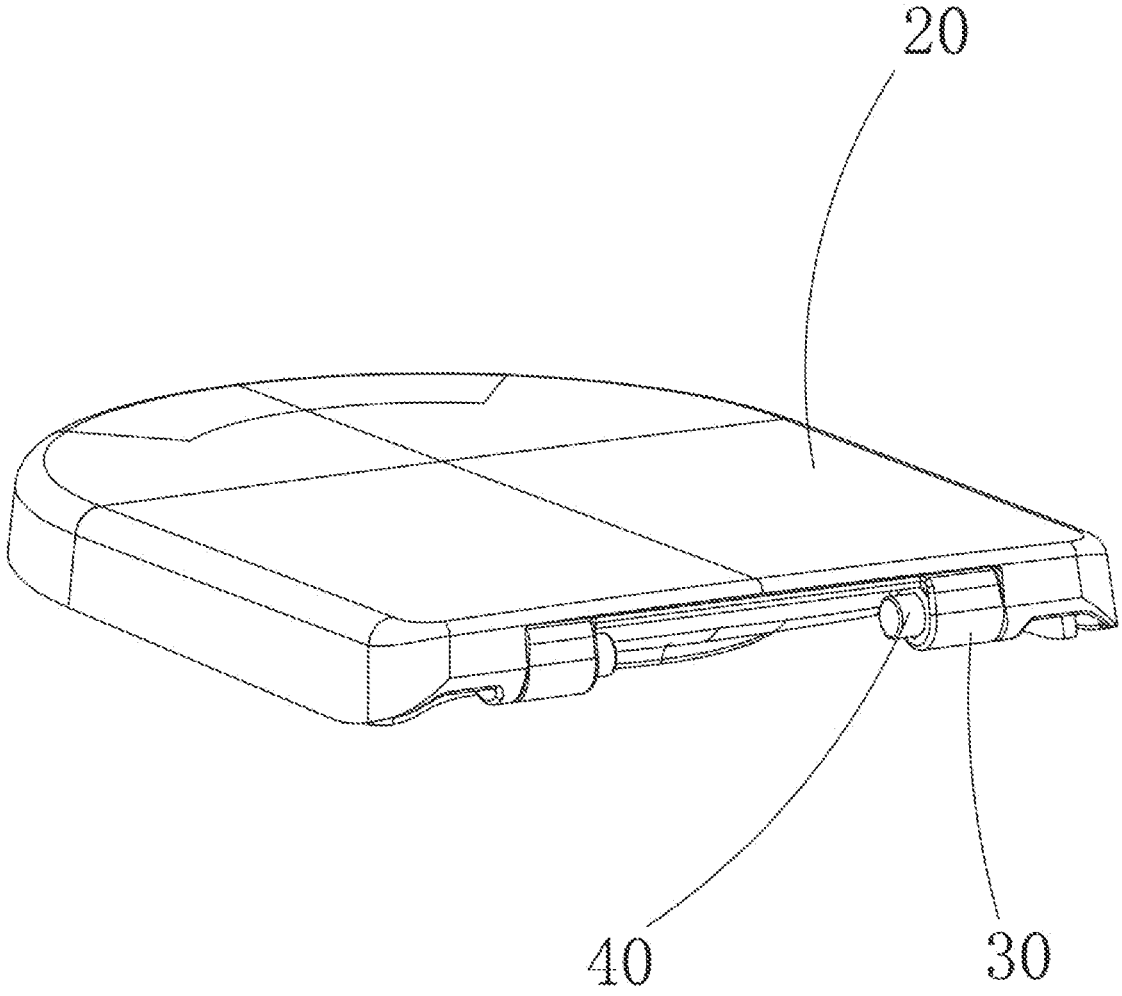
FIG. 10 is a schematic structural diagram of a toilet installation component according to an embodiment of the present disclosure.
Figure 11:
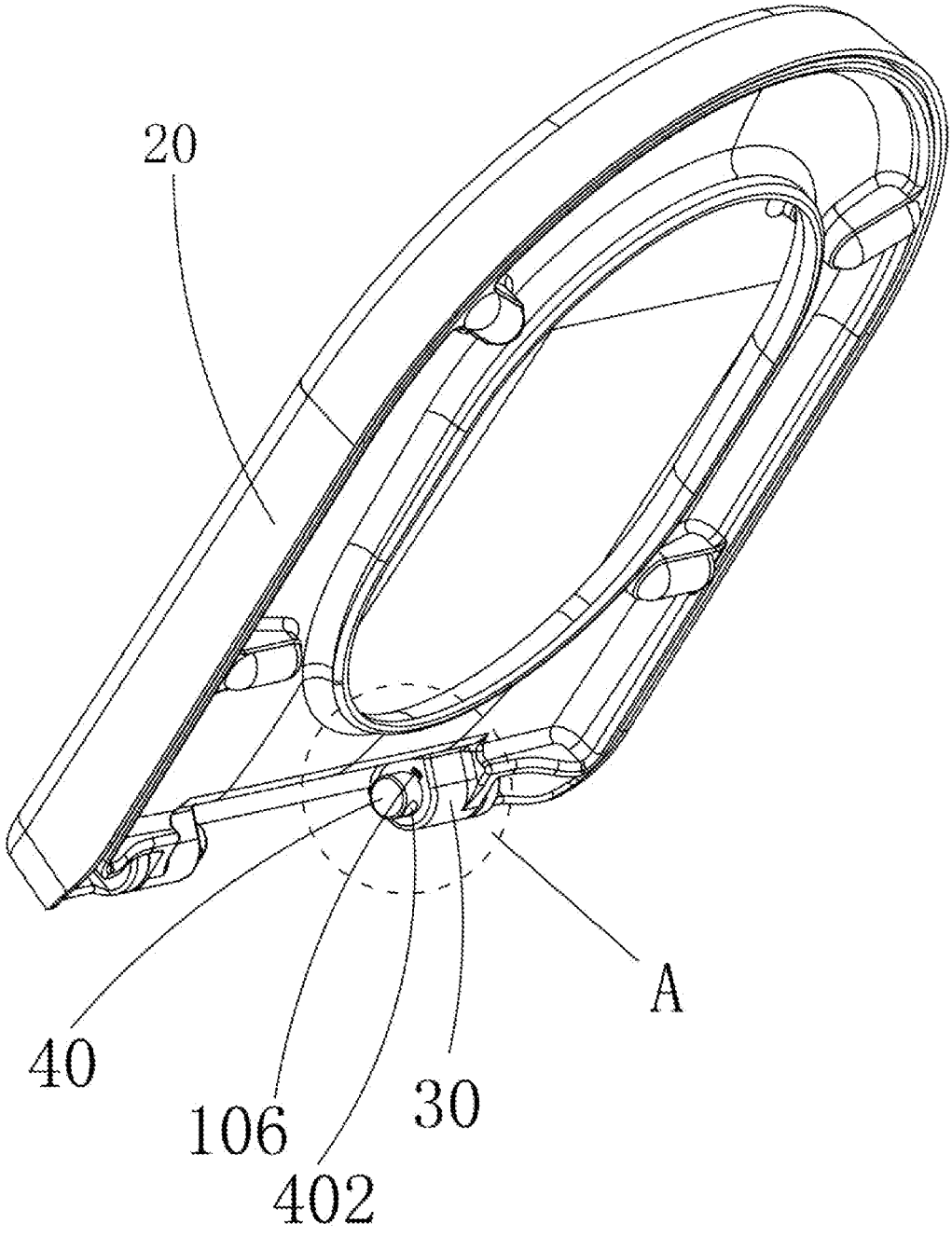
FIG. 11 is a schematic structural diagram of a toilet installation component according to an embodiment of the present disclosure from another viewing angle.
Figure 12:
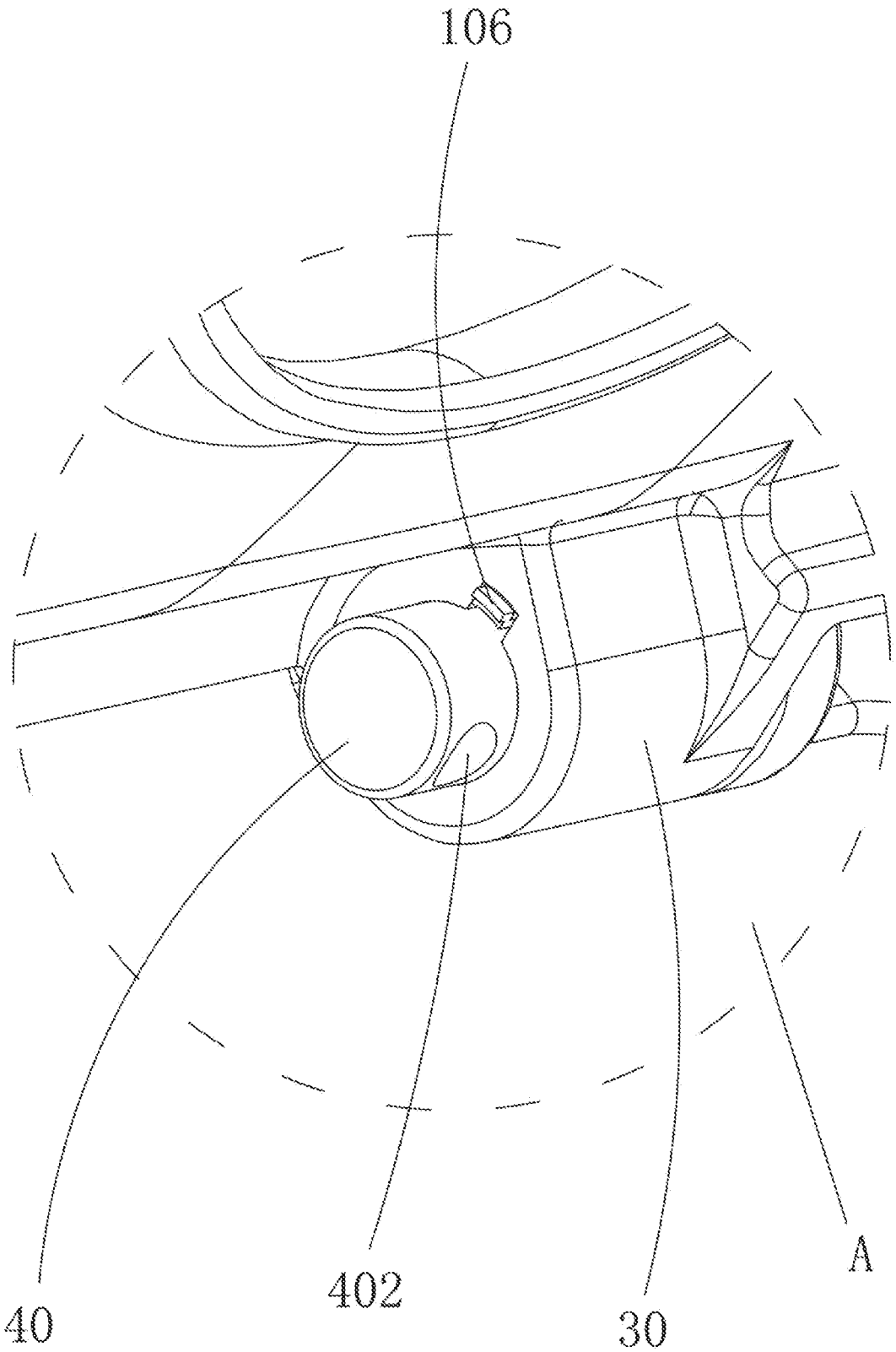
FIG. 12 is an enlarged diagram of a part A of FIG. 11.
Figure 13:
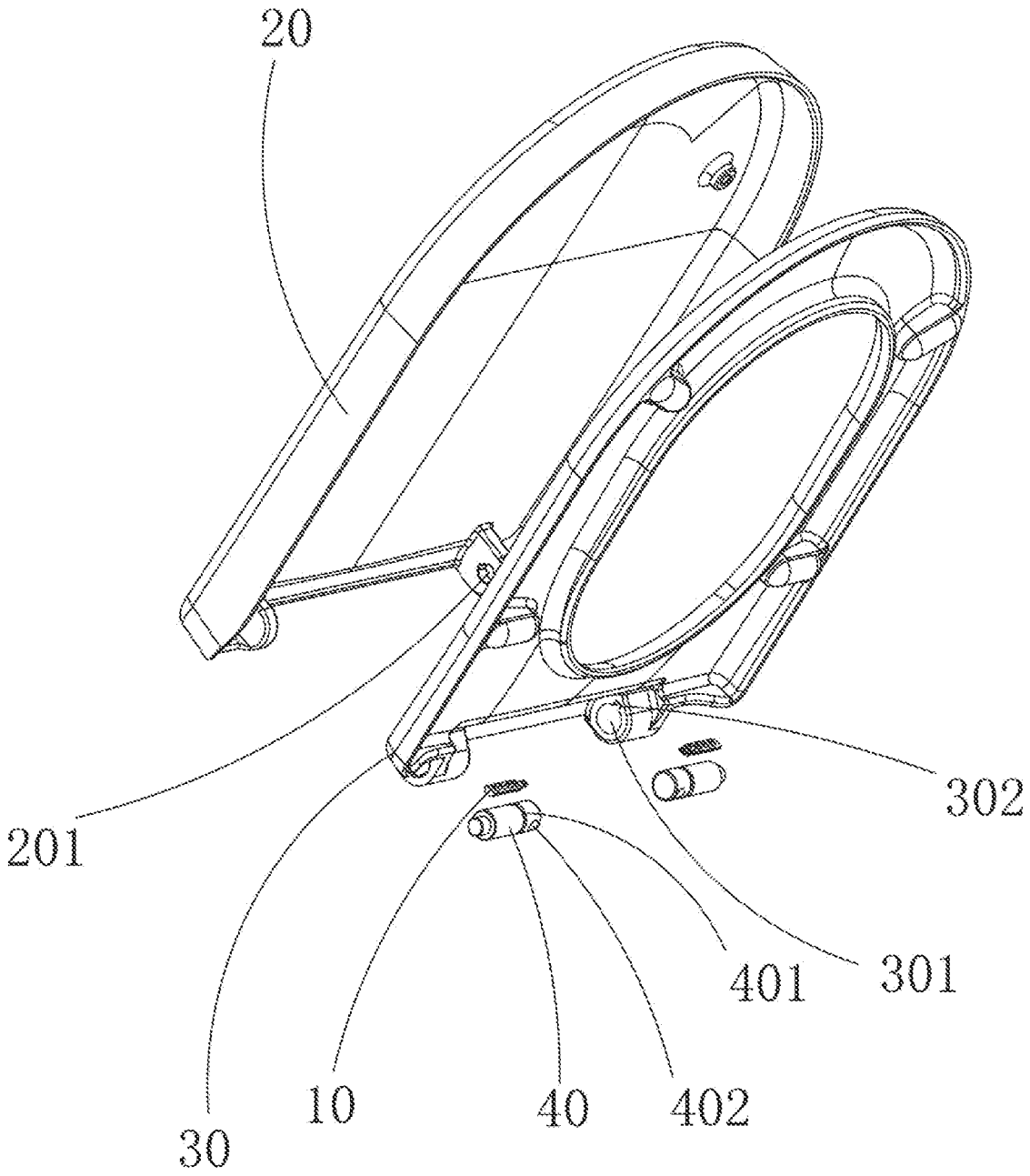
FIG. 13 is a schematic breakdown structure diagram of a toilet installation component according to an embodiment of the present disclosure.
Figure 14:
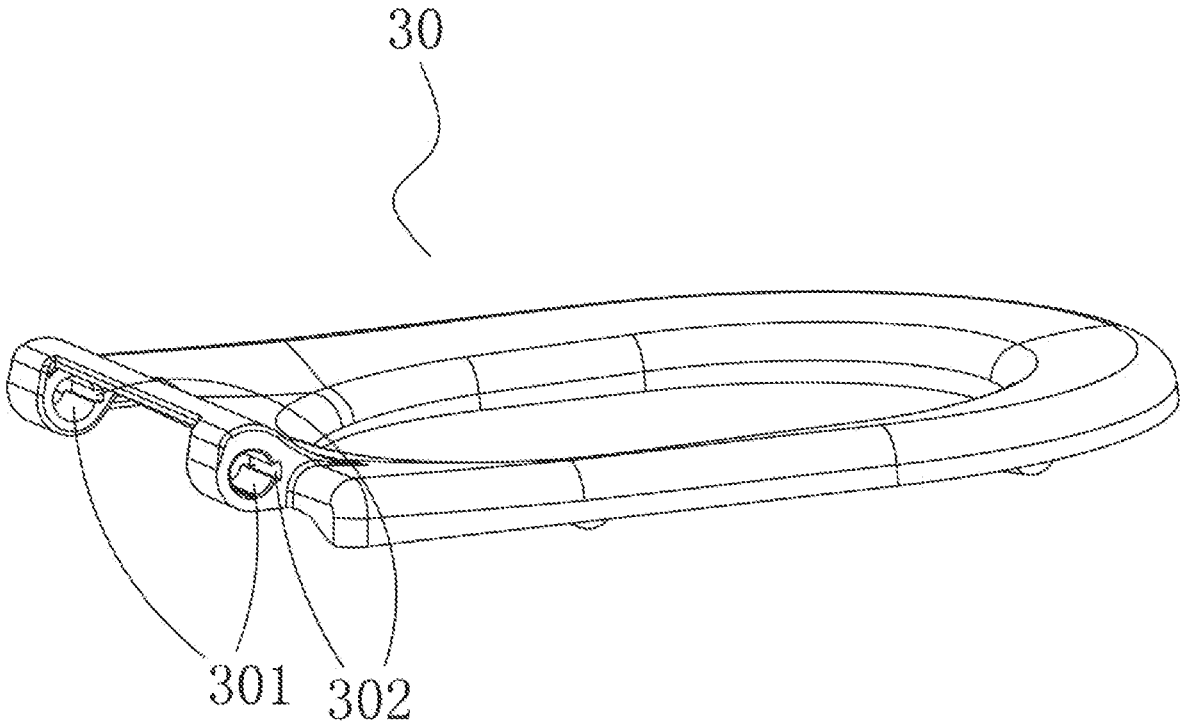
FIG. 14 is a schematic structural diagram of a toilet seat ring according to an embodiment of the present disclosure.

As an embodiment, as shown in FIG. 6-FIG. 8, the connector 10 has a fixing piece 101, a first end of the fixing piece 101 extends to form a first opening 102, the first end of the fixing piece 101 further extends to form the elastic piece 103, one side of the elastic piece 103 is provided with a hook 104, the first opening 102 is formed in the other side opposite to the hook 104, and a width of the first opening 102 is greater than a width of the elastic piece 103.

That is to say, the first end of the fixing piece 101 extends to form the first opening 102 and the elastic piece 103, and the width of the first opening 102 is greater than the width of the elastic piece 103, so that the elastic piece 103 can smoothly move radially through the first opening 102 when subjected to external acting force.

As an embodiment, a depth of the hook 104 is greater than a depth of the fixing piece 101.

That is to say, when the elastic piece 103 is not subjected to the action of external force, the depth of the hook 104 is greater than the depth of the fixing piece 101, so as to perform limiting through the hook 104.

As an embodiment, an end of the hook 104 away from the elastic piece 103 is provided with a section 105.

It should be noted that the section 105 is a side away from the fixing piece 101.

In other words, the section 105 is disposed on one side of the hook 104 away from the fixing piece 101, so that the hook 104 is easily clamped.

As an embodiment, an end of the elastic piece 103 away from the fixing piece 101 is provided with the shifting knob 106, and a step is formed between the shifting knob 106 and the elastic piece 103.

That is to say, when the shifting knob 106 is lifted by the external force to a direction away from the rotating shaft 40, the elastic piece 103 drives the hook 104 to move to a direction away from the rotating shaft 40, so that the hook 104 is clamped out. When the external force is released, the hook 104 is reset and clamped in for limiting.

To sum up, the connector of the present disclosure has the elastic piece 103, the elastic piece 103 is provided with the hook 104, and the first end of the elastic piece 103 is provided with the shifting knob 106, so that the connector can be quickly disassembled without the help of the tool, and meanwhile can adapt to various toilet cover plates, so as to improve the universality and meanwhile reduce the cost.

As shown in FIG. 9-FIG. 14, a toilet installation component of an embodiment of the present disclosure includes a toilet cover 20, a toilet seat ring 30, a rotating shaft 40 and a connector 10.

Wherein, the toilet cover 20 is provided with a first through hole 201; the toilet seat ring 30 is provided with a second through hole 301; the rotating shaft 40 penetrates through the second through hole 301 and is connected with the first through hole 201 of the toilet cover 20, or the rotating shaft 40 penetrates through the first through hole 201 and is connected with the second through hole 301 of the toilet seat ring 30, and the rotating shaft 40 is provided with a first clamping groove 401. The connector 10 is disposed in the first through hole 201 or the second through hole 301, and a hook 104 is inserted into a first clamping groove 401 of the rotating shaft 40.

That is to say, there are two installation modes between the connector 10 and the rotating shaft 40. One is that the connector 10 is disposed in the first through hole 201, and the rotating shaft 40 penetrates through the first through hole 201 and is connected with the second through hole 301 of the toilet seat ring 30, so that the hook 104 on the connector 10 is inserted into the first clamping groove 401 of the rotating shaft 40 for limiting. The other is that the connector 10 is disposed in the second through hole 301, and the rotating shaft 40 penetrates through the second through hole 301 and is connected with the first through hole 201 of the toilet cover 20, so that the hook 104 on the connector 10 is inserted into the first clamping groove 401 of the rotating shaft 40 for limiting.

That is to say, by inserting the hook 104 into the first clamping groove 401 of the rotating shaft 40 for limiting, when it needs to disassemble, the shifting knob 106 is manually shifted to a direction away from the rotating shaft 40, so that the hook 104 follows to be separated from the first clamping groove 401, and the rotating shaft 40 can be easily pulled out from the first through hole 201 or the second through hole 301 to complete the disassembly of the toilet cover plate.

As an embodiment, a second end of the elastic piece 103 is provided with a fixing piece 101, the first through hole 201 or the second through hole 301 is internally provided with a first groove 302, and the first groove 302 is internally provided with a second clamping groove matched with the fixing piece 101.

As an embodiment, the fixing pieces 101 are symmetrically disposed on left and right sides of the elastic piece 10, the first through hole 201 or the second through hole 301 is internally provided with the first groove 302, and the first groove 302 is internally provided with the second clamping groove matched with the fixing pieces 101.

As an embodiment, the connector 10 is disposed in the first groove 302, and the fixing piece 101 is disposed in the second clamping groove so as to fix the connector 10 axially.

As an embodiment, the shifting knob 106 extends beyond the first through hole 201 or the second through hole 301.

It should be noted that the connector 10 is disposed in the first groove 302, so that the connector 10 is hidden in the toilet seat ring 30, which not only has a firm structure, falling prevention, and convenient installation, but also has a beautiful appearance.

In addition, since the shifting knob 106 extends beyond the first through hole 201 or the second through hole 301, during disassembly, a user can directly use hands to shift it outside to further facilitate disassembly.

As another embodiment, the connector 10 may further be integrally formed with the toilet seat ring 30 to dispose the connector 10 in the first through hole 201 or the second through hole 301.

It should be noted that the connector 10 is integrally formed with the toilet seat ring 30, which further increases structural firmness and an anti-falling effect of the connector 10.

As an embodiment, the rotation shaft 40 is provided with the clamping groove 401 in a circumferential direction.

As an embodiment, the rotating shaft 40 is connected with the first through hole 201 through a first end, and a second groove 402 is formed in a lower portion of a second end of the rotating shaft 40.

It should be noted that when the rotating shaft 40 needs to be disassembled, the hook 104 follows to be separated from the first clamping groove 401 by manually shifting the shifting knob 106. That is, the rotating shaft 40 can be easily pulled out from the second through hole 301 through the second groove 402 so as to quickly complete the disassembly of the toilet cover plate.

To sum up, according to the toilet installation component of the embodiment of the present disclosure, the toilet cover is provided with the first through hole; the toilet seat ring is provided with the second through hole; the rotating shaft penetrates through the second through hole and is connected with the first through hole of the toilet cover or the rotating shaft penetrates through the first through hole and is connected with the second through hole of the toilet seat ring, and the rotating shaft is provided with the first clamping groove; and the connector has the elastic piece, the elastic piece is provided with the hook, the first end of the elastic piece is provided with the shifting knob, the connector is disposed in the first through hole or the second through hole, and the hook is inserted in the first clamping groove of the rotating shaft. Therefore, the connector can be quickly disassembled without the help of a tool, and meanwhile can adapt to various toilet cover plates, so as to improve universality and meanwhile reduce cost.

In the description of the present disclosure, it should be understood that an orientation or position relationship indicated by terms "center", "longitudinal", "transversal", "length", "width", "thickness", "upper", "lower", "front", "rear", "left", "right", "vertical", "horizontal", "top", "bottom", "inner", "outer", "clockwise", "anticlockwise" and the like is an orientation or position relationship shown on the basis of the accompanying drawings, is only to facilitate description of the present disclosure and simplify the description, rather than indicating or implying that the indicated apparatus or element must have a specific orientation or be constructed and operated in the specific orientation, and therefore cannot be understood as limitation on the present disclosure.

In addition, the terms "first" and "second" are only used for descriptive objectives, and cannot be understood as indicating or implying relative importance or implicitly indicating the quantity of the indicated technical features. Therefore, the features defined as "first" and "second" may explicitly or implicitly include one or more features. In the description of the present disclosure, unless otherwise limited expressly and specifically, the meaning of "the plurality of" is two or more than two.

In the present disclosure, unless otherwise expressly stated and limited, the terms "install", "connect", "link", "fix" and the like should be understood in a broad sense, for example, they may be fixed connection, or detachable connection, or integration; may be mechanical connection, or electrical connection; and may be direct connection, or indirect connection through an intermediate medium, or internal communication of two elements or interaction between the two elements. Those ordinarily skilled in the art may understand the specific meaning of the above terms in the present disclosure according to the specific situation.

In the present disclosure, unless otherwise expressly specified and limited, the first feature being "above" or "below" the second feature may include that the first feature and the second feature are in direct contact, or that the first feature and the second feature are not in direct contact but in contact through other features between them. Moreover, the first feature being "on", "above" and "upon" the second feature includes that the first feature is directly above and obliquely above the second feature, or only indicates that a horizontal height of the first feature is higher than that of the second feature. The first feature being "beneath", "under" and "below" the second feature includes that the first feature is directly below and obliquely below the second feature, or only indicates that the horizontal height of the first feature is smaller than that of the second feature.

In the description of the specification, description referring to the terms "one embodiment", "some embodiments", "an example", "specific examples", or "some examples" means that the specific features, structures, materials, or characteristics described in combination with the embodiment or example are contained in at least one embodiment or example of the present disclosure. In the specification, the schematic expression of the above terms should not be understood as necessarily referring to the same embodiment or example. Moreover, the described specific features, structures, materials or characteristics may be combined in a proper mode in any one or more embodiments or examples. In addition, those skilled in the art can coalesce and combine different embodiments or examples described in the specification.

Although the embodiments of the present disclosure have been shown and described above, it may be understood that the above embodiments are exemplary and cannot be understood as limitation on the present disclosure. Those ordinarily skilled in the art can change, modify, replace and transform the above embodiments within the scope of the present disclosure.

What is claimed is:

1. A connector, wherein the connector has an elastic piece, the elastic piece is provided with a hook, and a first end of the elastic piece is provided with a shifting knob; the first end of the elastic piece forms a step by bending to obtain the shifting knob; a second end of the elastic piece is provided with a fixing piece; and the fixing piece is of a ring sleeve structure.

2. A connector, wherein the connector has an elastic piece, the elastic piece is provided with a hook, and an end of the elastic piece is provided with a shifting knob; the end of the elastic piece forms a step by bending to obtain the shifting knob; and fixing pieces are symmetrically disposed on left and right sides of the elastic piece.

3. A toilet installation component, comprising:

a toilet cover, provided with a first through hole;

a toilet seat ring, provided with a second through hole;

a rotating shaft, penetrating through the second through hole and connected with the first through hole of the toilet cover or penetrating through the first through hole and connected with the second through hole of the toilet seat ring, wherein the rotating shaft is provided with a first clamping groove; and a connector, having an elastic piece, wherein the elastic piece is provided with a hook, a first end of the elastic piece is provided with a shifting knob, the connector is disposed in the first through hole or the second through hole, and the hook is inserted in the first clamping groove of the rotating shaft.

4. The toilet installation component according to claim 3, wherein a second end of the elastic piece is provided with a fixing piece, the first through hole or the second through hole is internally provided with a first groove, and the first groove is internally provided with a second clamping groove, wherein the second clamping groove is matched with the fixing piece.

5. The toilet installation component according to claim 4, wherein the fixing pieces are symmetrically disposed on left and right sides of the elastic piece, the first through hole or the second through hole is internally provided with the first groove, and the first groove is internally provided with the second clamping groove, wherein the second clamping groove is matched with the fixing pieces.

6. The toilet installation component according to claim 4, wherein the connector is disposed in the first groove, and the fixing piece is disposed in the second clamping groove to fix the connector axially.

7. The toilet installation component according to claim 3, wherein the shifting knob extends beyond the first through hole or the second through hole.

8. The toilet installation component according to claim 5, wherein the connector is disposed in the first groove, and the fixing piece is disposed in the second clamping groove to fix the connector axially.

* * * * *